United States Patent [19]

Hartwell

[11] 4,296,973

[45] Oct. 27, 1981

[54] SEGMENTED HARDFACED COLLAR FOR TOOL JOINTS

[76] Inventor: Charles A. Hartwell, P.O. Box 36589, Houston, Tex. 77036

[21] Appl. No.: 110,646

[22] Filed: Jan. 9, 1980

[51] Int. Cl.[3] ..... F16C 29/02

[52] U.S. Cl. ..... 308/4 A; 166/241

[58] Field of Search ..... 308/4 A, 4 R, 4 C, 3 R; 166/241; 175/325

[56] References Cited

U.S. PATENT DOCUMENTS

| | | | |
|---|---|---|---|
| 3,978,933 | 9/1976 | Olson et al. | 308/4 A |
| 3,993,368 | 11/1976 | Jurgens et al. | 308/4 A |
| 4,043,611 | 8/1977 | Wallace | 308/4 A |
| 4,081,203 | 3/1978 | Fuller | 308/4 A |

*Primary Examiner*—Lenard A. Footland

*Attorney, Agent, or Firm*—Gunn, Lee & Jackson

[57] ABSTRACT

A segmented hardfaced collar for tool joints is disclosed. In the preferred and illustrated embodiment, a wear resistant tool joint suitably dressed for use is disclosed. It is formed at externally upset box tool joints. The apparatus comprises, in the preferred embodiment, a pair of semicircular segments which fully encircle and are joined to the lower portions of the box tool joint. The segments are perforated with a plurality of holes, and cylindrical inserts are pressed into them made of hard material to extend the life of the tool joint. The several inserts are distributed around the semicircular segments and are held in position by means of a friction fit or brazing material applied to the joint.

5 Claims, 2 Drawing Figures

SEGMENTED HARDFACED COLLAR FOR TOOL JOINTS

BACKGROUND OF THE DISCLOSURE

In drilling an oil well, abrasive wear is normally inflicted on the tool joints of the drill string. Efforts have been made in the past to protect tool joints of a drill string. In particular, the tool joints which join sections of the drill collars and drill pipe have been reinforced by various hardfacing, coatings, sleeves or reinforcings. Typically, such materials have utilized tungsten carbide at or around the tool joint. As exemplified in U.S. Pat. No. 3,993,368, one such apparatus has been adapted. As stated thereat, it is intended to provide a tool joint able to tolerate the wear and tear inflicted on the tool joint through the use of hardfacing material.

A tool joint ordinarily represents an external upset in the drill string. The term "external upset" describes the bulge or enlargement in the drill string which occurs at the pin and box connection which comprises the tool joint. Typically, there is a downwardly facing shoulder of some angular construction and radial extent. This shoulder has heretofore been provided with a hardfacing material to reduce the wear at the shoulder and thereby carry the load placed on the tool joint in the particular region where wear most commonly occurs. For instance, it is possible to obtain from the Hughes Tool Company unitized tool joints with the Hughes-X hardfacing applied to it. According to the advertising for this product, a tungsten carbide hardfacing for tool joints is provided which wears well even when run inside casing. When a drill string extends through a cased hole, there is inevitably some risk that the hardfaced tool joint will rub or otherwise abrade against the casing, itself, metal rubbing against metal, which is highly undesirable. Therefore, great efforts have been made to reduce the risk or danger of the hard metal rubbing against the casing and thereby damaging it.

After a tool joint has been used for a significant period of time, the outer surface is inevitably worn away, mostly in uncased holes in abrasive formations, thereby reducing the physical dimensions. As the tool joint is reduced in diameter, it must eventually be replaced or resurfaced for restoration to the original gauge. The manufacturing process by which resizing to a full gauge diameter poses some problems. Consider, as an example, the following problems in resizing a tool joint. In U.S. Pat. No. 3,993,368, there is disclosed a set of rectangular inserts of hardface material in a surrounding sleeve which is divided into two portions. The surrounding sleeve can be removed, either one or both portions, and can thereafter be replaced. To a great extent, if the worn sleeve is discarded, it will be rather wasteful because a significant portion of the worn sleeve still constitutes useful hardface material in the form of inserts in the sleeve. In that event, an alternate approach is the repair step of placing hardface material on the worn sleeve to build the sleeve back up to the gauge diameter of a new sleeve and thereby restore the tool joint to its original dimensions. Through the use of welding procedures, a supportive metal matrix with tungsten carbide particles can be installed to thereby restore the tool joint to gauge size and condition.

In the repair of worn tool joints equipped with hardfacing, problems can arise. As an example, a tool joint is normally equipped with a cylindrical outer face which is typically worn away. As wearing occurs, the body of the tool joint disappears which inevitably results in a distortion of the adjacent shoulder. The shoulder must typically have specified dimensions which match a set of dimensions found on pipe handling elevators used at the drilling rig. This, however, is difficult to achieve in reconstructing a worn tool joint by simply welding additional hardface material onto the tool joint. Grinding in the field or at a welding shop is inappropriate and probably inefficient.

In the instance where attempts are made to repair as by welding, including the process of welding tungsten carbide particles in a matrix around the downwardly facing elevator shoulder, extradordinary quantities of heat are placed on the tool joint, and the heat warps or damages the tool joint where it connects with the body of the pipe. The present invention provides a tool joint construction with hardfacing which avoids the risk of distortion from excessive heat. The present apparatus overcomes limitations known heretofore which relate primarily to the fact that an external sleeve (formed of one or multiple segments) formed into a cylinder and supporting a number of inserts is positioned about the lower end of the tool joint. More wear occurs at the lower end. The hardfacing materials used in the past tend to wear more rapidly at that area, and, in the event of repairs, such repairs have ordinarily involved placing by welding of additional hardfacing material around the lower end of the tool joint. This requires careful welding in the vicinity of the downwardly facing shoulder which must taper at a specified angle to cooperate with elevators used in handling pipe. Moreover, the heat which is applied in the vicinity of the shoulder at the time of redressing creates warpage on the body of the pipe connected to the tool joint.

From the foregoing, it will be understood that certain limitations on previous methods of tool joint repair must be noted. A second limitation results from placing excessive heat at a tool joint. Excessive heat may well reduce metal strength by reducing the temper of the steel. The limitations based on warpage and heating of the drill pipe proper, particularly in the vicinity of the weld between the tool joint and the drill pipe, must be avoided. A further notable limitation is restraint on the buildup of the wear surface of the tool joint in the near vicinity of the lower end of the tool joint while maintaining a suitable profile for engaging pipe supporting elevators. Pipe supporting elevators are constructed in accordance with an industry standard having an 18.0-degree taper seat. The seat cooperates with an 18.0-degree taper at the lower end of the tool joint. In the event of repair as by building up the outside surface of the tool joint, there is risk that the tool joint profile will not be preserved and thereby create a mismatch between tool joint and elevator profile. Another factor of interest is a limitation on the length of the tool joint. So to speak, an external area of reduced diameter is cut to receive the hardfacing inserts. It is cut on the lower exterior portion of the tool joint just below the box, and such a cut reduces the metal in the body for supporting the tensile stress load transferred from pipe to pipe through the tool joint. It will be appreciated that the box end includes a tapered internal thread on a skirt. As metal is removed to leave room for a circular sleeve supporting hardfacing material, it forms a relatively narrow throat with limited structural material and creates a point of stress concentration. Because this stress concentration must be limited, there is a practical limit on the size of the recess which is cut in the box, and the hardface surface area is thereby limited.

The present apparatus is a hardfacing insert attached to a tool joint having a recessed area which avoids excessive stress concentration in the box. Moreover, it supports a set of tungsten carbide inserts which provide a hardfacing feature without creating stress concentrations in the box and which can further be installed and repaired without warping the connection between the tool joint and the pipe.

The present apparatus is, therefore, summarized as a hardfacing attachment in the form of a pair of semicircular sleeves positioned in a recess on a tool joint. The recessed area does not extend to the weld which affixes the tool joint to the pipe and terminates at a distance such that welding at the recess prevents warpage and resultant damage from heating. The recess further terminates short of the box threads. The recess is shaped to receive the insert and thereby support a plurality of tungsten carbide inserts in a semicircular blank. The tungsten carbide inserts supported on a semicircular sleeve are installed by a friction fit or by brazing. The inserts conform to the taper for the tool joint to enable it to be supported by pipe handling elevators. Moreover, surface dressing after partial wear is permitted.

BRIEF DESCRIPTION OF THE DRAWINGS

So that the manner in which the above recited features, advantages and objects of the invention, as well as others which will become apparent, are attained and can be understood in detail, a more particular description of the invention briefly summarized above may be had by reference to the embodiments thereof illustrated in the appended drawings, which drawings form a part of this specification. It is to be noted, however, that the appended drawings illustrate only typical embodiments of the invention and are not to be considered limiting of its scope, for the invention may admit to other equally effective embodiments.

DETAILED DESCRIPTION OF THE PREFERRED EMBODIMENT

Figure 1:
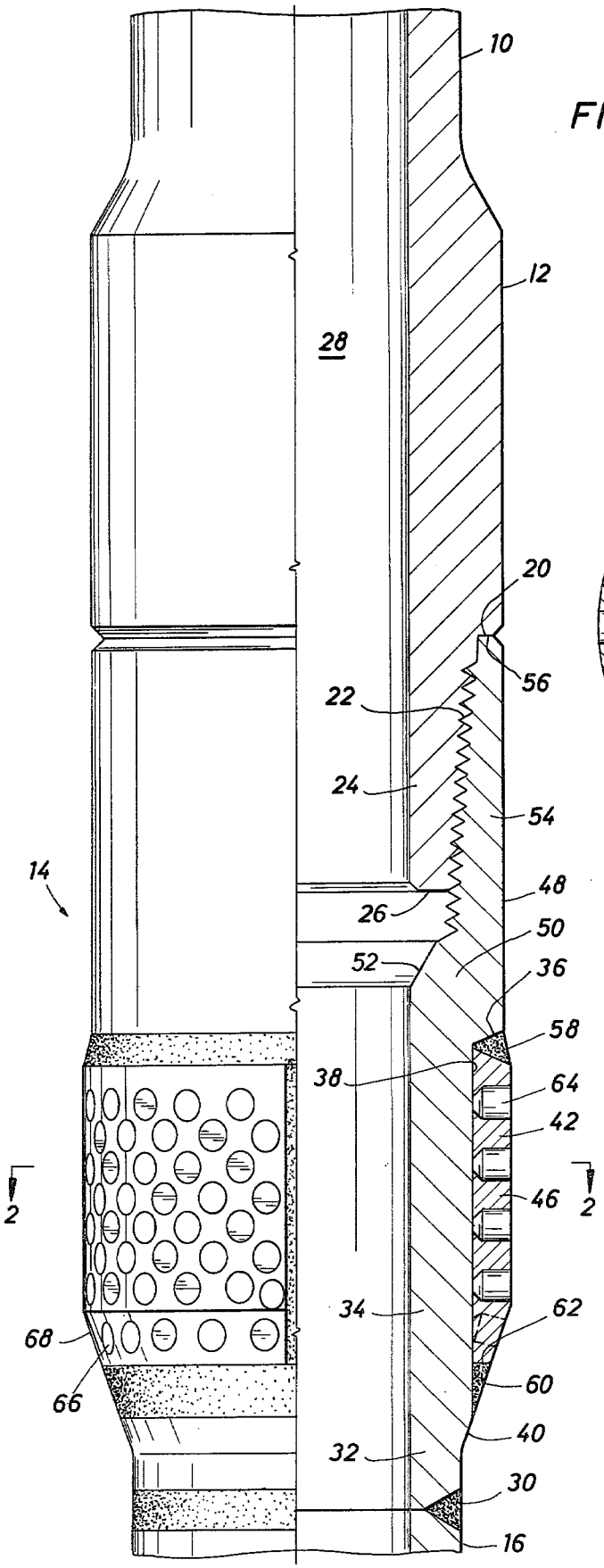
FIG. 1 is a sectional view of the hardfacing tool joint of the present invention partly in section.

Attention is directed to FIG. 1 of the drawings, where a tool joint is shown. Briefly, an upper drill pipe 10 terminates at a pin connector 12 which, in turn, threads to a box 14 welded to a lower drill pipe 16. This arrangement is utilized in forming a drill string typically several thousand feet or more in length. Considering the structure of FIG. 1 in greater detail, the tool joint is made of the pin and box connection shown in FIG. 1. The pin incorporates a shoulder 20 which is immediately adjacent to a set of threads 22 formed on a tapered skirt 24 comprising the male connector. The skirt 24 terminates at a shoulder 26 which extends radially inwardly to the axial passage 28 through the tool joint. It will be observed that the tool joint formed of the pin and box connectors is larger in outside diameter than the pipes 10 and 16. The internal passage which extends through the two joined pipes is uniform between pipes 10 and 16. This defines an external upset pipe. The internal passage is provided to deliver drilling mud, while the drill bit is rotated by imparting rotation to the drill string from the top of the well. The O.D. enlargement thus makes contact against the well bore more readily than the drill pipe, itself. To this extent, most wear which occurs in the use of the drill string occurs at the tool joint. Primarily, this wear occurs at the lower portions of the tool joint.

The lower part of the tool joint includes the box connection. It is joined to the pipe 16 at a weld 30 which is a carefully formed weld attaching the box to the pipe. The weld extends circumferentially about the apparatus, securing the components together. The weld 30 is exposed to a significant amount of stress and, therefore, must be carefully made. Even when carefully made, it cannot be subjected to subsequent heating in the near vicinity of the weld 30. Such prospect would expose the weld to damage and run the risk of catastrophic failure. More will be noted concerning the location of the weld 30 and the box.

The tool joint box comprises an elongate tubular member 32 having a thickened portion at 34. The thickened portion 34 extends to a step or shoulder 36 immediately adjacent to a cylindrical surface 38 formed along the exterior surface to the shoulder 36. The cylindrical surface 38 terminates at a gradually sloping shoulder 40 at the lower end which terminates a selected distance from the weld 30. Welding should not occur below the shoulder 40. Rather, the cylindrical external surface 38 supports all welding required to attach the hardfacing surface.

Figure 2:
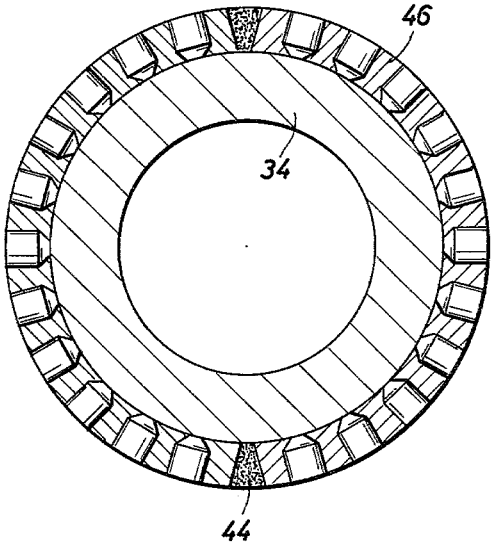
FIG. 2 is a sectional view along the line 2—2 of FIG. 1.

A hardfacing assembly comprised of two semicircular blanks is placed on the surface 38 and located above the shoulder 40. A semicircular blank (a split cylinder) is identified by the numeral 42, typically formed of steel having a hardness appropriate for 4140 or similar steel. It can be harder or softer under different circumstances. It is concentric and, therefore, fits about the surface 38. The two identical semicircular blanks encircle the cylindrical surface 38, and the two blanks are welded together at 44 (see FIG. 2). The semicircular blanks define a common outer face 46 having a slightly larger diameter than the outer face 48 on the remainder of the box connector above the shoulder 36. The surface 48 is ideally an extension of the outer surface of the pin connector 12.

A region 50 is located between the external shoulder 38 and an internal taper 52 which faces the shoulder 26 to define a gap or space therebetween. The region 50 defines a throat constrained by the shoulder 36 at the lower end and the taper 52 at the upper end. Stress concentration in the throat area 50 is limited by the profile which defines it. The box connector further includes the unitary skirt 54 which terminates at an end located shoulder 56 abutting against the shoulder 20, and suitable tapered threads are cut on the interior of the skirt to mate with the threads 22. When the pin and box are joined together, threaded connection is made, and the shoulder 26 spaces from the taper 52 as illustrated.

The present invention comprises the semicircular blanks which are positioned around the external surface 38 and are welded in position. A circular weld bead is formed at 58 and fully encircles the apparatus. A second weld 60 is formed at the lower end. The weld 58 is formed against the shoulder 36. The circular sleeve 42 is formed with a tapered upper face to define a welding groove adjacent the shoulder 36. At the lower end, space is left for the weld 60 by terminating the sleeve at the transverse shoulder 62.

The present apparatus includes a plurality of tungsten carbide inserts. Several identical inserts 64 are utilized and are positioned in holes drilled in the semicircular sleeve 42. Briefly, the tungsten carbide inserts have the form of a right cylinder with an O.D. slightly larger than the drilled hole in the sleeve, fitting with an interference fit. Preferably, the inserts extend slightly higher than the sleeve resulting from an upstanding cylinder on a curved face. In other words, they stand slightly above the outside surface of the sleeve and terminate at a flat face at or above a curved face. The holes formed in the sleeve preferably pass fully through the sleeve to expose the back face of the pellet. Moreover, manufacturing process economies are typically achieved by forming the holes fully through the sleeve. The pellet is formed with a bottom bevel, the bevel more or less conforming to the shape of the hole. The tungsten carbide inserts are held in position by an interference fit. If desired, although certainly not necessary, it is permissible to braze the tungsten carbide inserts at the exposed internal face of the sleeve 42 positioned on the cylindrical surface 38.

Several inserts are included, and they are positioned in rows with slight overlap from row to row. The overlap assures that, speaking vertically and circumferentially, the entire cylindrical face is protected by tungsten carbide inserts. The overlap between rows of inserts is sufficient so that the entire face of the hardfacing assembly is protected by hardened inserts. It will be recalled that they stand slightly higher than the surface, and they wear down to become concentric with the semicircular sleeve 42.

A shorter pellet 66 is incorporated and is located in a cylindrical hole drilled on the lower tapered face of the sleeve 42. The face 68 is in actuality an extension of the tapered shoulder 40 and the weld 60. These three collectively extend at an 18.0-degree angle. The 18.0-degree face is thus made of several segments including the shoulder 40 at the bottom. The face is protected against wear at the upper end by the inserts 66. They are drilled at an angle, being perpendicular to the face 68 and extending at an angle toward the cylindrical surface 38. The inserts 66 are thus similar to the inserts 64, except they are positioned in angled holes and are relatively short. They are attached by an interference fit in the preferred embodiment.

Certain advantages of the apparatus shown in FIG. 1 are made more apparent from explanation. The wear surface is the slightly larger external surface of the hardfacing attachment. It is worn across the entire face 46 with some concentration of the wear toward the lower end. This wear is primarily carried by the tungsten carbide inserts. As they wear away, their height is reduced, and the sleeve 42 is worn away. The face 68 also wears, but wear is limited by the tungsten carbide inserts 66. Wear at this face typically has the form of rounding with the wear at the upper end of the 18.0-degree face. While some wear occurs at the lower end, this is typically minimal and occurs only when the drill string passes through a key slot or other irregularity in the well bore. The significant area of contact is the cylindrical surface 46.

As wear occurs, the wear rounds the top end of the 18.0-degree tapered face and the enlarged face 46. Eventually, these must be repaired. Repairs become appropriate when they are sufficiently out of gauge or about equal to the diameter of the tool joint at 46. One mode of repair is to weld a layer of new metal on the face 46. The welding step is accomplished in the following manner. The weld is built up through the use of rod material supporting distributed particles of tungsten carbide. As the weld is built up, the dimensions are restored to gauge measurements, and tungsten carbide particles restore the necessary hardness and abrasive resistant surface. An alternate method is to cut out the welds 44, 58 and 60 with a gas cutting torch, electric arc, or by machining to remove the worn parts and replace them.

This welding step is accomplished with a significant amount of heat. The welding occurs above the shoulder 62 in FIG. 1. The weld 60 serves as a means for fastening the cylindrical sleeve around the tool joint. The weld 60 serves somewhat as a fillet to extend the profile of the tapered face. Recognizing this as the definitive lower limit of the addition of weld material to the partially worn hardfacing surface, heat which is liberated at the weld or fillet 60 and thereabove is sufficiently spaced from the weld 30 to avoid warpage and loss of strength from heating. This feature prevents damage to the weld 30. All the welding that occurs above the fillet 60 does not warp or damage the lower weld 30.

An important feature of the present invention is in the vicinity of the throat 50. The weld 58 adds metal in the area of the throat, but it is generally undesirable to place tensile stress on the weld 58. The tensile stress must, therefore, be carried in the body below the shoulder 36 and the cylindrical surface 38. The stress lines are concentrated through the throat 50 without exceeding a predetermined level. The throat 50 thus limits the upward extent of the hardfacing on the tool joint. The throat area must have a minimum dimension depending on the stress levels to be placed on the drill string. Representative measures for the length of the hardfacing is around 4.0 to 4.5 inches for a 10.0-inch long tool joint.

Fabrication of this apparatus involves the manufacture of the box with the cylindrical outer surface 38 exposed. The box is joined at the weld 30 to the pipe. The semicylindrical sleeve portions are fitted with a plurality of tungsten carbide inserts. They are positioned in the holes formed in the semicircular sleeves. Two such sleeves are then positioned around the tubular member against the surface 38 and welded in place. They are welded by two circumferential beads which hold them together. They are welded lengthwise at 44 at two locations. This secures and fastens the hardfacing material to the box 14.

After use, wear accumulates on the outer cylindrical surface 46. The surface 46 is reduced in gauge as the wear accumulates. Eventually, the hardfacing area is repaired, and the repairs include the fabrication steps of applying a welded layer supportive matrix with tungsten carbide particles therein to the outer surface.

After the outer surface has been built back up to the full diameter, the sloping face having a taper of 18.0 degrees is reshaped by careful deposit of metal, metal removal and other fabrication steps. This continues until the apparatus is restored to full gauge. This is accomplished only with substantial heating. As heat is liberated, it is conducted along the metal toward the weld 30. The weld 30 is spaced from the surrounding semicircular sleeve 42 by a distance such that the heat is not so extreme as to warp or otherwise damage the weld 30. The level of heat inflicted on it is not that severe. When finished, the tapered shoulder having an 18.0-degree angle conforms to the original construction to enable the pipe to be handled by pipe elevators.

In operation, the tool joint carries stress load from the threads in the box past the throat 50. Undue stress concentrations are avoided inasmuch as the shoulder 36 is located at an adequate spacing relative to the taper 52 to prevent undue stress concentrations. Undue stress concentrations are prevented by construction of the throat area 50 with sufficient cross-sectional area to accommodate the stress load on the pipe. This particular calculation is often dependent on scale factors. Within the scope of this disclosure, the scale is such that the concentrated stress across the throat area 50 does not exceed a selected level, say fifty percent (50%) of yield as a maximum. A lower stress level, by design, can be selected. In part, the stress level depends on the cross-sectional area of the throat 50, the angle of the shoulders which define the throat, relative size and many similar factors. An important factor is the margin of safety, typically a ceiling on stress and usually a percentage of yield stress.

While the foregoing is directed to the preferred embodiment, the scope thereof is determined by the claims which follow.

I claim:

1. In a well pipe tool joint formed of a lower threaded tubular body serially affixed to a drill pipe and adapted to be connected with a complementary threaded tubular tool joint body for supporting a drill string, the improvement which comprises wear protector means extending circumferentially about the lower tubular body in an axially extending region wherein said wear protector means comprises an elongate, externally located tubular sleeve terminating at a lower circumferential shoulder located on the lower tubular body at or beyond a specified distance from a weld joining the lower tubular body to a lower pipe and which wear protector means has the form of an encircling cylindrical sleeve supporting hard metal facing thereon wherein said sleeve extends externally upwardly toward a shoulder on the lower tubular body defining a throat area within the lower tubular body which throat area is equal to or exceeds a specified dimensional size from the shoulder to a set of threads formed on the interior of the lower tubular body and wherein said sleeve terminates at a sloping circular shoulder constructed at an angle and extent in accordance with an industry standard and at least one hole drilled therein at said sloping shoulder has a hard metal facing insert therein.

2. The apparatus of claim 1 wherein said drill pipe tool joint lower tubular body is protected by a plurality of hard metal facing having the form of right cylindrical inserts received in a circumferentially extended row of holes formed for said inserts.

3. The apparatus of claim 2 including a lower sloping face on said sleeve and at least one row of inserts of hard metal facing therein and wherein said sleeve comprises two or more portions joined to said lower tubular body by welding.

4. The apparatus of claim 1 wherein said sloping shoulder is extended with a sloping shoulder on said lower tubular body and including a welding fillet adjacent to said sloping shoulders and wherein said sloping shoulders collectively conform to the industry standard.

5. The apparatus of claim 4 wherein said throat area is defined by a circumferential weld securing said tubular sleeve about the lower tubular body, the body being axially hollow and having an internal shoulder adjacent to the threads.

* * * * *